US010695766B2

(12) United States Patent
Irmak et al.

(10) Patent No.: US 10,695,766 B2
(45) Date of Patent: Jun. 30, 2020

(54) WEAR-RESISTANT ELEMENT FOR A COMMINUTING DEVICE

(71) Applicants: THYSSENKRUPP INDUSTRIAL SOLUTIONS AG, Essen (DE); thyssenkrupp AG, Essen (DE)

(72) Inventors: Baris Irmak, Beckum (DE); Ingo Neitemeier, Ennigerloh (DE); Marcel Bannert, Soest (DE)

(73) Assignees: THYSSENKRUPP INDUSTRIAL SOLUTIONS AG, Essen (DE); THYSSENKRUPP AG, Essen (DE)

( * ) Notice: Subject to any disclaimer, the term of this patent is extended or adjusted under 35 U.S.C. 154(b) by 37 days.

(21) Appl. No.: 16/071,354

(22) PCT Filed: Jan. 12, 2017

(86) PCT No.: PCT/EP2017/050558
§ 371 (c)(1),
(2) Date: Jul. 19, 2018

(87) PCT Pub. No.: WO2017/125309
PCT Pub. Date: Jul. 27, 2017

(65) Prior Publication Data

US 2019/0344282 A1 Nov. 14, 2019

(30) Foreign Application Priority Data

Jan. 22, 2016 (DE) ..... 10 2016 200 912

(51) Int. Cl.
*B02C 4/00* (2006.01)
*B02C 4/30* (2006.01)

(52) U.S. Cl.
CPC ..... *B02C 4/305* (2013.01); *B02C 2210/02* (2013.01)

(58) Field of Classification Search
CPC ..... B02C 4/305; B02C 2210/02
(Continued)

(56) References Cited

U.S. PATENT DOCUMENTS 412,558 A * 10/1889 Stephens ..... B02C 4/305 241/294
3,805,364 A 4/1974 Gardner
(Continued)

FOREIGN PATENT DOCUMENTS

CL 2018001679 A 10/2018
CN 202272489 U 6/2012
(Continued)

OTHER PUBLICATIONS

English Translation of International Search Report issued in PCT/EP2017/050558, dated Mar. 6, 2017 (mailed Mar. 15, 2017).

*Primary Examiner* — Faye Francis
(74) *Attorney, Agent, or Firm* — thyssenkrupp North America, LLC

(57) ABSTRACT

A wear-resistant element for partially inserting into a recess in the surface of a wear surface of a comminuting device. The wear-resistant element has a fastening region, which is connectable to the recess in the surface of the wear surface and a wearing region, which protrudes at least partially from the surface of the wear surface. The fastening region includes a material that is less wear-resistant than the material of the wearing region, wherein the wearing region extends beyond the fastening region at the level of the wear-resistant element.

14 Claims, 3 Drawing Sheets

(58) Field of Classification Search
USPC ..... 241/300
See application file for complete search history.

(56) References Cited

U.S. PATENT DOCUMENTS

| | | | | | |
|---|---|---|---|---|---|
| 4,347,988 | A * | 9/1982 | Warren | B02C 13/2804 | 241/275 |
| 5,054,702 | A * | 10/1991 | Heinemann | B02C 4/305 | 241/230 |
| 5,203,513 | A * | 4/1993 | Keller | B02C 4/305 | 241/235 |
| 5,238,046 | A * | 8/1993 | Guerard | B02C 4/305 | 164/110 |
| 5,269,477 | A * | 12/1993 | Buchholtz | B02C 4/305 | 241/293 |
| 5,704,561 | A * | 1/1998 | Ansen | B02C 4/305 | 241/293 |
| 5,836,525 | A * | 11/1998 | Garnier | D21D 1/306 | 241/28 |
| 8,256,698 | B2 * | 9/2012 | Holmes | B02C 1/04 | 241/207 |
| 2005/0061901 | A1 * | 3/2005 | Burchardt | B02C 4/305 | 241/297 |
| 2007/0184235 | A1 * | 8/2007 | Leclercq | B02C 4/305 | 428/67 |
| 2007/0215733 | A1 * | 9/2007 | Splinter | B02C 4/30 | 241/221 |
| 2008/0142272 | A1 | 6/2008 | Hall | | |
| 2008/0265073 | A1 * | 10/2008 | Sommer | B02C 4/08 | 241/231 |
| 2009/0218429 | A1 * | 9/2009 | Hagedorn | B02C 4/305 | 241/294 |
| 2010/0025512 | A1 * | 2/2010 | Liimatainen | B02C 13/2804 | 241/300 |
| 2011/0248550 | A1 * | 10/2011 | Knotts | B02C 4/08 | 299/105 |
| 2012/0048976 | A1 * | 3/2012 | Hofmann | B02C 4/305 | 241/230 |
| 2012/0073105 | A1 * | 3/2012 | Botto | B02C 1/10 | 29/426.2 |
| 2013/0284840 | A1 * | 10/2013 | Packeisen | B02C 4/305 | 241/235 |
| 2013/0299618 | A1 * | 11/2013 | Sharman | B02C 1/10 | 241/300 |
| 2014/0183291 | A1 * | 7/2014 | Frangenberg | B02C 4/305 | 241/294 |
| 2014/0252144 | A1 * | 9/2014 | Dallimore | B02C 13/1835 | 241/30 |
| 2015/0083839 | A1 * | 3/2015 | De Weldige | B02C 4/305 | 241/227 |
| 2016/0107410 | A1 * | 4/2016 | Madok | B02C 4/305 | 428/99 |
| 2016/0318025 | A1 * | 11/2016 | Frangenberg | B30B 3/005 | |
| 2016/0367994 | A1 * | 12/2016 | Birtch | B02C 4/305 | |
| 2017/0043347 | A1 * | 2/2017 | Berglund | B02C 4/305 | |
| 2017/0043349 | A1 * | 2/2017 | Guerard | B22D 19/02 | |
| 2018/0071743 | A1 * | 3/2018 | Olsson | B02C 2/005 | |
| 2019/0015837 | A1 | 1/2019 | Irmak | | |

FOREIGN PATENT DOCUMENTS

| | | | |
|---|---|---|---|
| CN | 202460732 | U | 10/2012 |
| CN | 102858457 | A | 1/2013 |
| CN | 203316191 | U | 12/2013 |
| CN | 104039454 | A | 9/2014 |
| CN | 203853119 | U | 10/2014 |
| DE | 102006010042 | A | 9/2007 |
| DE | 102009050636 | B | 5/2011 |
| DE | 102013107100 | A | 1/2015 |
| EP | 0 699 479 | A | 3/1996 |
| EP | 2940169 | A | 11/2015 |
| WO | 2012/092427 | A | 7/2012 |
| WO | 2016/150719 | A | 9/2016 |

* cited by examiner

WEAR-RESISTANT ELEMENT FOR A COMMINUTING DEVICE

CROSS REFERENCE TO RELATED APPLICATIONS

This application is a U.S. National Stage Entry of International Patent Application Serial Number PCT/EP2017/050558, filed Jan. 12, 2017, which claims priority to German Patent Application No. DE 10 2016 200 912.5, filed Jan. 22, 2016, the entire contents of both of which are incorporated herein by reference.

FIELD

The present disclosure generally relates to a wear-resistant element for partially inserting into a recess in the surface of a wear surface of a comminuting device.

BACKGROUND

In comminuting devices, such as grinding rollers, which are used in particular in material bed comminution of for example hard ore, a high level of wear of the surface of a wear surface, for example the grinding roller surface, occurs during operation of the comminuting device. In order to counteract this wear, it is known, for example from DE 2006 010 042 A1, to mount additional wear-resistant elements on the surface of the grinding roller. At a particular degree of wear, it is necessary to replace the wear-resistant elements of the grinding roller in order to ensure efficient grinding. The replacement of the wear-resistant elements entails for example long downtimes of the roller mill and high maintenance costs.

Thus a need exists for a wear-resistant element which has a high level of wear resistance in order to increase the maintenance intervals for replacing the wear-resistant elements, wherein the wear-resistant element is at the same time cost-effective to produce.

DETAILED DESCRIPTION

Figures 1, 2:
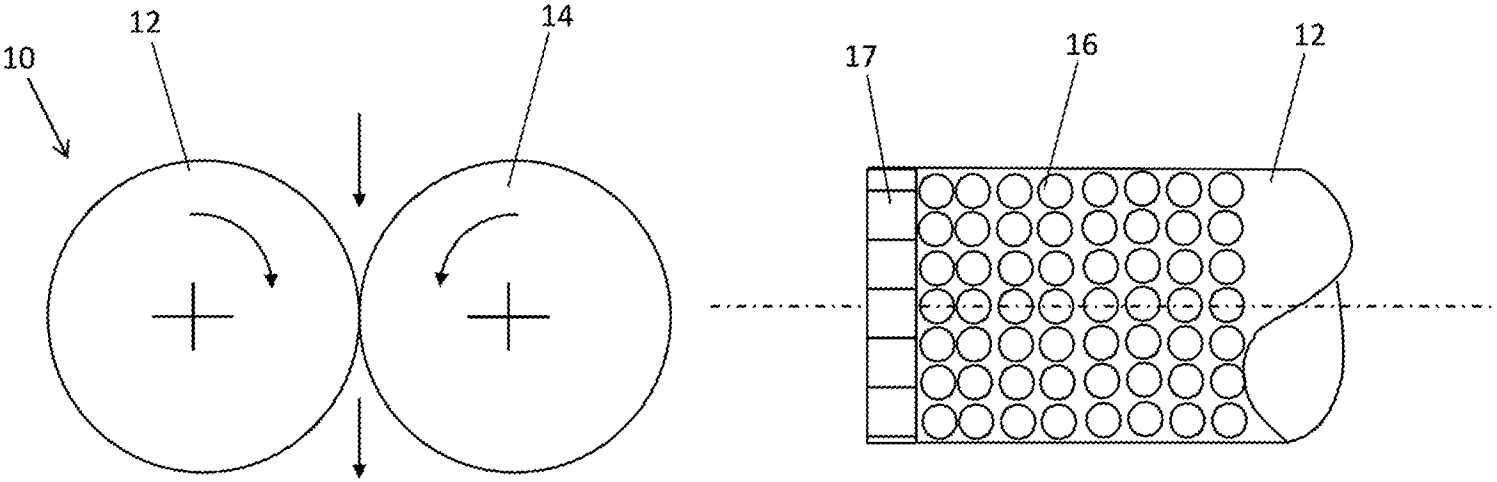
FIG. 1 is a schematic front view of a comminuting device according to one exemplary embodiment.
FIG. 2 is a schematic view of a grinding roller of the comminuting device according to FIG. 1.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element, even where other elements in the same claim or different claims are preceded by 'at least one' or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

The invention relates to a wear-resistant element for partially inserting into a recess in the surface of a wear surface of a comminuting device, and to a comminuting device having such a wear-resistant element.

According to a first aspect, the present invention relates to a wear-resistant element for partially inserting into a recess in the surface of a wear surface of a comminuting device, wherein the wear-resistant element has a fastening region, which is connectable to the recess in the surface of the wear surface, and a wearing region, which protrudes at least partially from the surface of the wear surface. The fastening region comprises a material that is less wear-resistant than the material of the wearing region, wherein the wearing region extends beyond the fastening region at the level of the wear-resistant element. The fastening region is furthermore formed in a sleeve-like manner.

The comminuting device is for example a roller mill, a roller crusher, a hammer mill or a vertical roller mill, wherein the wear surface is in particular the surface of a grinding roller, the hammer tools and the surface of the grinding track of a hammer mill, or the surface of the rollers and of the grinding table of a vertical roller mill, which are subject to a high level of wear during operation of the comminuting device.

The wear-resistant element is formed for example in a cylindrical manner or has a square cross section. In particular, one end of the wear-resistant element is configured such that it is fastenable to the surface of the wear surface, in particular in a recess in the surface of the wear surface. In particular, the wear-resistant element is formed in a plate-shaped manner. This is advantageous in particular when such a wear-resistant element is used on for example a grinding track of a hammer mill or a vertical roller mill.

The fastening region is preferably arranged such that, during operation of the comminuting device, it is not subject to any wear or is subject to only very little wear. In particular, the fastening region serves for fastening the wear-resistant element to the surface of the wear surface. The wearing region is arranged in the fastening region and extends beyond the fastening region at the level of the wear-resistant element, such that the wearing region is subject to the majority of the wear acting on the wear-resistant element. Such a wear-resistant element is much more cost-effective to produce, since it is possible to dispense with forming the entire wear-resistant element from the expensive more wear-resistant material. The region of the wear-resistant element which is subject to no wear or only to very little wear, has a less wear-resistant material, resulting in lower material costs. A sleeve-like fastening region affords the advantage of particularly easy producibility. The term sleeve-like should be understood as meaning in particular that the fastening region is formed in a cylindrical manner with a central, coaxial cutout facing the wearing region. The fastening region has preferably a lower cylindrical region, on which the wearing region bears, and an upper, for example thin-walled sleeve-like region, which circumferentially encloses the wearing region at least partially. The sleeve-like region has in particular at least the same longitudinal extent as or a greater longitudinal extent than the cylindrical region. The wearing region has preferably a cylindrical region, which is configured such that it cooperates with the sleeve-like region of the fastening region with a precise fit. In particular, the wearing region is configured entirely as a cylinder.

According to a first embodiment, the material of the wearing region comprises a ceramic material, for example tungsten carbide WC, titanium carbide TiC, titanium carbonitride TiCN, vanadium carbide VC, chromium carbide CrC, tantalum carbide TaC, boron carbide BC, niobium carbide NbC, molybdenum carbide Mo2C, aluminum oxide Al2O3, zirconium oxide ZrO2, or silicon carbide SiC. Furthermore, preferably particles of industrial diamonds, in particular high-strength ceramics, are embedded in a ceramic or metallic matrix in the wearing region.

The material of the fastening region comprises, according to a further embodiment, a steel, for example a quenched and tempered structural steel.

According to a further embodiment, the fastening region has a receiving region for receiving the wearing region, which is configured such that it centers the wearing region relative to the fastening region. The receiving region is preferably formed on that side face of the fastening region that faces the wearing region. In particular, that face of the wearing region that faces the fastening region is configured such that it cooperates with the receiving region.

According to a further embodiment, the receiving region has at least one cutout and the wearing region has a protrusion which cooperates with the cutout. In particular, the receiving region has a protrusion and the wearing region has a corresponding cutout.

According to a further embodiment, the wear-resistant element has an end-side cutout, in particular a bore, which faces in the direction of the wear surface of the comminuting device. Preferably, the fastening region has the end-side cutout. The cutout is formed in particular coaxially with the wear-resistant element. Such a cutout brings about a saving of material of the fastening region and thus a reduction in cost of the wear-resistant element.

According to a further embodiment, the wearing region is arranged at least partially within the sleeve-like region of the fastening region. The sleeve-like fastening region arranged at least partially around the wearing region affords the advantage of a simple arrangement of the wearing region on the fastening region and easy finish-machining of the casing of the wear-resistant element.

According to a further embodiment, the fastening region and the wearing region are bonded together substance-to-substance, in particular adhesively bonded or soldered. Screwing the wearing region and the fastening region together is likewise conceivable. Substance-to-substance bonding affords a simple possibility of fastening the wearing region to the fastening region, wherein the wearing region is mounted on the fastening region preferably releasably, such that the wearing region is easy to replace when it becomes worn. Therefore, it is not necessary to replace the fastening region in the event of the wearing region becoming worn.

According to a further embodiment, the fastening region comprises less than 45%, preferably less than 30%, most preferably less than 20% of the wear-resistant element.

The invention furthermore relates to a comminuting device having a wear surface and a wear-resistant element as described above, wherein the wear-resistant element is mounted at least partially in a recess in the surface of the wear surface, in particular of a grinding roller.

The advantages described with regard to the wear-resistant element also apply to the comminuting device having such a wear-resistant element.

According to a further embodiment, the fastening region of the wear-resistant element is bonded substance-to-substance to the grinding roller, in particular, welded, adhesively bonded or soldered. Preferably, the fastening region is soldered, adhesively bonded or welded to the recess in the wear surface.

The comminuting device is for example a grinding roller for material bed comminution or a vertical roller mill.

FIG. 1 schematically illustrates a comminuting device 10, in particular a roller mill. The comminuting device 10 comprises two grinding rollers, illustrated schematically as circles, having wear surfaces 12, 14 which have the same diameter and are arranged alongside one another. Formed between the wear surfaces 12, 14 of the grinding rollers is a grinding gap, the size of which is settable, for example.

During operation of the comminuting device 10, the grinding rollers rotate in opposite directions to one another in directions of rotation illustrated by the arrows, wherein grinding stock passes through the grinding gap in the falling direction and is ground.

FIG. 2 shows an end region of a grinding roller which has a wear surface 12, on which wear-resistant elements 16 are mounted. The wear-resistant elements 16 are mounted in the outer circumference of the surface of the grinding roller. For example, the mutually spaced-apart wear-resistant elements 16, arranged alongside one another, in FIG. 2 have a circular cross section. It is likewise conceivable for the wear-resistant elements 16 to vary in terms of size, number, cross-sectional shape and arrangement with respect to one another over the surface of the grinding roller, in order for example to compensate for local differences in wearing during operation of the comminuting device 10.

Furthermore, the grinding roller has wear-resistant corner elements 17, mounted on its end, which have for example a rectangular cross section and are arranged in a row alongside one another such that they form a ring around the circumference of the grinding roller. Further cross-sectional shapes of the wear-resistant corner elements 17, which differ from the cross-sectional shape shown in FIG. 2, are furthermore conceivable. A mutually spaced-apart arrangement of the wear-resistant corner elements 17 is also possible. In FIG. 2, by way of example, only the left-hand end of the grinding roller having the wear surface 12 is shown, wherein the right-hand end, which is not shown, is advantageously of identical construction.

Figures 3, 4, 5:
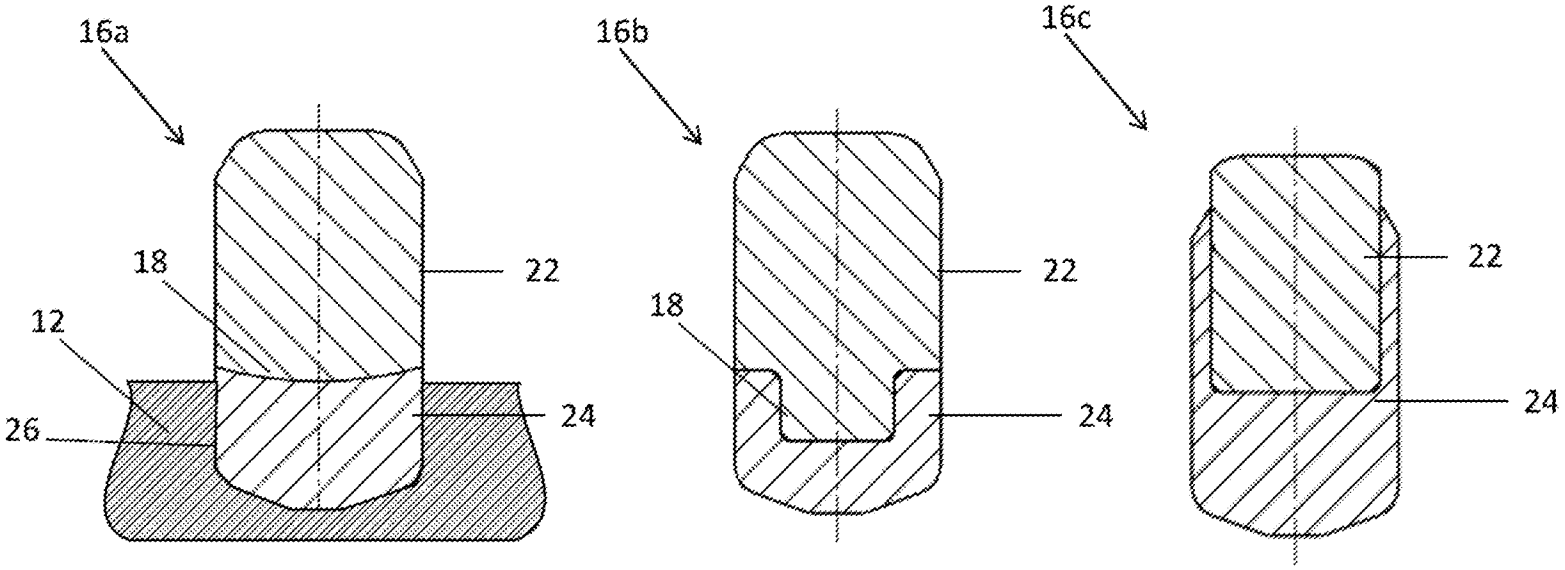
FIG. 3 is a schematic cross-sectional view of an exemplary embodiment of a wear-resistant element.
FIG. 4 is another schematic cross-sectional view of an exemplary embodiment of a wear-resistant element.
FIG. 5 is another schematic cross-sectional view of an exemplary embodiment of a wear-resistant element.

FIG. 3 shows a wear-resistant element **16*a* that is not encompassed by the invention, said wear-resistant element 16*a* being arranged in a recess 26 in the wear surface 12 of the grinding roller according to FIGS. 1 and 2. The wear-resistant element 16*a* has a fastening region 24 and a wearing region 22, wherein the fastening region is arranged in the recess 26 in the surface of the wear surface 12 of the grinding roller and is connected to the wear surface 12 of the grinding roller. For example, in the fastening region 24, the wear-resistant element 16*a* is bonded substance-to-substance to the recess in the surface of the wear surface 12 of the grinding roller, in particular welded, soldered or adhesively bonded or connected in a form-fitting manner, in particular screwed or wedged. The wearing region 22 of the wear-resistant element 16*a* is arranged at least partially outside the recess 26 in the wear surface 12, such that said wearing region protrudes from the surface of the wear surface 12 in a radial direction of the grinding roller (not illustrated). The fastening region 24 comprises, in the exemplary embodiment illustrated, about one third of the entire wear-resistant element 16***a*, wherein the wearing region 22 comprises approximately the further two thirds. The fastening region 24 has a receiving region 18, which comprises that face of the fastening region that faces the wearing region 22. The receiving region 18 is arranged between the wearing region 22 and the fastening region 24 and configured in particular in a bulging manner such that the fastening region 24 of the wear-resistant element 16*a* has an inwardly directed bulge at the end facing the wearing region 22. This bulge serves for positioning the wearing region 22 on the fastening region 24.

The wearing region 22 of the wear-resistant element 16*a* has a material having a higher level of wear resistance than the material of the fastening region 24. For example, the wearing region 22 has a ceramic material, for example tungsten carbide, titanium carbide, titanium carbonitride, vanadium carbide, chromium carbide, tantalum carbide, boron carbide, niobium carbide, molybdenum carbide, aluminum oxide, zirconium oxide, or silicon carbide. Furthermore, it is also possible for particles of industrial diamonds or high-strength ceramics to be embedded in a ceramic or metallic matrix in the wearing region. For example, the wearing region has a matrix material in which a majority of particles are arranged. The particles in question are in particular a highly wear-resistant material which comprises for example diamond, ceramic or titanium. The matrix material comprises for example tungsten carbide. The particles are bonded in particular substance-to-substance, for example by sintering with the matrix material.

During operation of the comminuting device 10, the wear-resistant elements 16*a* are subject to a high level of wear, wherein in particular the wearing region 22, protruding from the surface of the wear surfaces 12, 14 of the grinding rollers, of the wear-resistant elements 16*a* becomes worn. The wear-resistant material of the wearing region 22 reduces the wear of the wear-resistant elements 16*a* considerably. Furthermore, it is possible to dispense with forming the fastening region, which is not subject to any wear or only to very little wear, from the expensive, more wear-resistant material.

FIG. 4 shows a further exemplary embodiment of a wear-resistant element 16*b*, wherein the wear surface having the recess 26, in which the wear-resistant element 16*b* is arranged, is not illustrated. FIG. 4 shows a wear-resistant element 16*b* which corresponds substantially to the wear-resistant element 16*a* in FIG. 1, wherein the receiving region, in particular that region of the fastening region 24 of the wear-resistant element 16*b* that faces the wearing region 22 has a cutout which cooperates with a protrusion in that region of the wear-resistant region 22 that faces the fastening region 24. Such a cutout in the fastening region 24 serves in particular for positioning the wearing region 22 on the fastening region 24, wherein the wearing region is centered relative to the fastening region 24. The cutout is formed for example in a cylindrical and centered manner.

FIG. 5 shows a wear-resistant element 16*c*, which has a substantially sleeve-like fastening region 24, wherein the latter extends along the lateral face of the wearing region 22 and the wearing region 22 is arranged at least partially within the sleeve-like fastening region 24. The sleeve-like fastening region 24 is formed from a softer, less wear-resistant material than the wearing region 22. The wearing region 22 of the wear-resistant element 16*c* extends beyond the sleeve-like fastening region 24 in the longitudinal direction of the wear-resistant element 16*c*, such that the wearing region 22 protrudes from the sleeve-like fastening region 24. The wearing region 22 extends in particular beyond the fastening region 24 in the radial direction of the grinding roller. The fastening region 24 in FIG. 5 has a lower, radially inwardly directed, fully cylindrical region, on which the wearing region 22 bears, and a radially outwardly directed, for example thin-walled sleeve-like region, which circumferentially surrounds the wearing region 22 at least partially.

Figure 6:
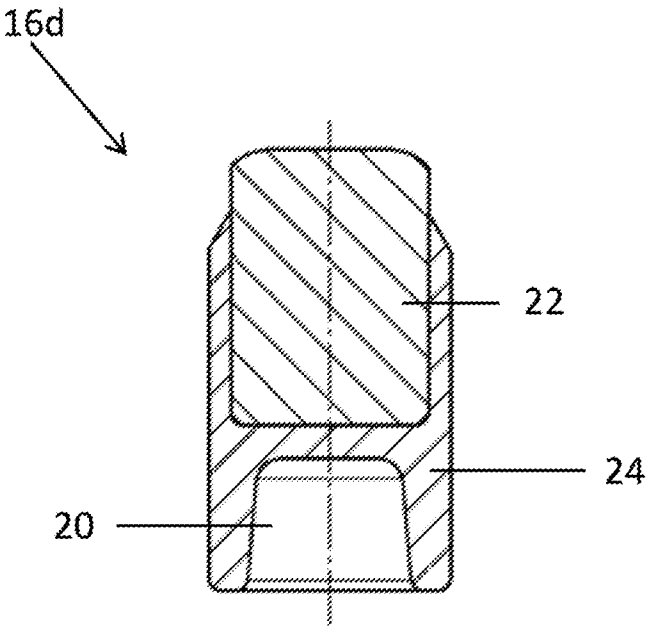
FIG. 6 is another schematic cross-sectional view of an exemplary embodiment of a wear-resistant element.

FIG. 6 shows a wear-resistant element 16*d* which corresponds substantially to the wear-resistant element 16*c* in FIG. 5 except that the wear-resistant element 16*d* has a cutout 20 in its fastening region 24. The cutout 20 is provided in the end face of the fastening region 24 and formed for example in a cylindrical or conical manner. The cutout is formed in particular coaxially with the wear-resistant element 16*d* and serves for example for fastening the wear-resistant element 16*d* in the recess 26 in the wear surface of the comminuting device 10. Furthermore, the cutout 20 results in a considerable material saving of the fastening region 24.

Figure 7:
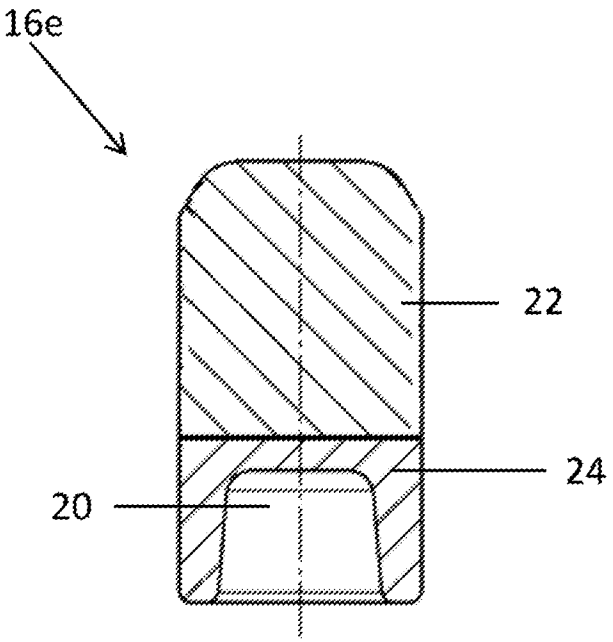
FIG. 7 is another schematic cross-sectional view of an exemplary embodiment of a wear-resistant element.

FIG. 7 shows a wear-resistant element 16*e*, not encompassed by the invention, which corresponds substantially to the wear-resistant element 16*a* in FIG. 3 except that the wear-resistant element 16*e* has a cutout 20 in the fastening region 24 as in FIG. 6. The receiving region 18 of the wear-resistant element 16*e* is formed in a substantially planar manner. A bulging configuration is likewise conceivable.

What is claimed is:

1. A comminuting device, comprising:

a grinding roller including a wear surface with a recess;

a wear-resistant element configured to partially insert into the recess, the wear-resistant element comprising:

a fastening region, and a wearing region, wherein the fastening region comprises a material that is less wear-resistant than the material of the wearing region, wherein the wearing region extends outwardly from the fastening region and wherein the fastening region includes a sleeve region that circumferentially surrounds the wearing region, wherein the fastening region has a receiving region for receiving the wearing region, which is configured such that it centers the wearing region relative to the fastening region, and the receiving region has a cutout and the wearing region has a protrusion which is configured to cooperate with the cutout to fit to the cutout and position the wearing region on the fastening region, or wherein the receiving region has a protrusion and the wearing region has a cutout which is configured to cooperate with the protrusion to fit to the protrusion and position the wearing region on the fastening region.

2. The comminuting device of claim 1, wherein the material of the wearing region comprises a ceramic material.

3. The comminuting device of claim 1, wherein the material of the fastening region comprises a steel.

4. The comminuting device of claim 1, wherein the wear-resistant element has an end-side cutout which faces in the direction of the wear surface.

5. The comminuting device of claim 1, wherein the wear-resistant element has a bore which faces in the direction of the wear surface.

6. The comminuting device of claim 1, wherein the wearing region is arranged at least partially within the sleeve of the fastening region.

7. The comminuting device of claim 1, wherein the fastening region and the wearing region are bonded together.

8. The comminuting device of claim 1, wherein the fastening region and the wearing region are adhesively bonded or soldered together.

9. The comminuting device of claim 1, wherein the fastening region comprises less than 45% of the wear-resistant element.

10. The comminuting device of claim 1, wherein the fastening region comprises less than 30% of the wear-resistant element.

11. The comminuting device of claim 1, wherein the fastening region comprises less than 20% of the wear-resistant element.

12. The comminuting device of claim 1, wherein the wear-resistant element is recessed at least partially in the wear surface.

13. The comminuting device of claim 1, wherein the fastening region of the wear-resistant element is bonded to the grinding roller.

14. The comminuting device of claim 1, wherein the fastening region of the wear-resistant element is welded, adhesively bonded or soldered to the grinding roller.

* * * * *